US008465314B2

(12) United States Patent
Kato

(10) Patent No.: US 8,465,314 B2
(45) Date of Patent: Jun. 18, 2013

(54) CARD EDGE CONNECTOR

(75) Inventor: Rintaro Kato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/337,963

(22) Filed: Dec. 27, 2011

(65) Prior Publication Data

US 2012/0164864 A1 Jun. 28, 2012

(30) Foreign Application Priority Data

Dec. 28, 2010 (JP) ..... 2010-293082

(51) Int. Cl.
*H01R 13/62* (2006.01)

(52) U.S. Cl.
USPC ..... 439/327

(58) Field of Classification Search
USPC ..... 439/325–329
See application file for complete search history.

(56) References Cited

U.S. PATENT DOCUMENTS 6,176,725 B1 * 1/2001 Kobayashi et al. ..... 439/326
6,634,899 B2 * 10/2003 Takahiro et al. ..... 439/328
6,743,028 B2 * 6/2004 Wang ..... 439/92
7,074,067 B2 * 7/2006 Yang et al. ..... 439/326
7,789,692 B2 * 9/2010 Lee ..... 439/327

FOREIGN PATENT DOCUMENTS

JP 11-016646 A 1/1999

* cited by examiner

*Primary Examiner* — Khiem Nguyen

(74) *Attorney, Agent, or Firm* — Holtz, Holtz, Goodman & Chick, P.C.

(57) ABSTRACT

A card edge connector is connectable to a card having a side edge. The card edge connector has a holding member extending in a first direction and a pair of arms each extending in a second direction perpendicular to the first direction from the holding member. Each of the arms includes an abutment portion and a spring portion. The spring portion is bendable elastically outward in the first direction. The spring portion has a latch and an abutting portion. The latch is engaged with the side edge of the card when the card edge connector is connected to the card. When the connected card presses the latch along a third direction perpendicular to both the first direction and the second direction, the abutting portion is brought into contact with the abutment portion so that the abutting portion regulates a movement of the latch in the third direction.

10 Claims, 6 Drawing Sheets

CARD EDGE CONNECTOR

CROSS REFERENCE TO RELATED APPLICATIONS

Applicants claim priority under 35 U.S.C. §119 of Japanese Patent Application No. JP2010-293082 filed Dec. 28, 2010.

BACKGROUND OF THE INVENTION

This invention relates to a card edge connector or a socket which is configured to be connected to a card having terminals provided in the vicinity of an edge thereof. For example, the card is a memory module.

For example, this type of connectors is disclosed in JP-A H11(1999)-16646, contents of which are incorporated herein by reference. The connector of JP-A H11(1999)-16646 is configured to be connected to a printed-circuit board (card). As shown in FIG. 12, the connector of JP-A H11(1999)-16646 has a bending piece (spring portion) and a fixing piece (fixing portion). The bending piece is provided with a holding piece (latch) while the fixing piece is provided with an abutting piece (stopper). When the spring portion is bent to be apart from the printed-circuit board, the stopper is brought into abutment with a part of the latch so that a bending range of the spring portion is regulated. Therefore, the spring portion is prevented from being bent excessively.

As for the connector of JP-A H11(1999)-16646, the latch might be damaged when the card connected to the connector is forced to be removed. Even if the latch is not damaged, the latch might come off the card.

SUMMARY OF THE INVENTION

It is therefore an object of the present invention to provide a card edge connector having a structure to prevent a card from being removed forcibly.

One aspect of the present invention provides a card edge connector attachable to a mounted object and connectable to a card having a side edge. The card edge connector card edge connector comprises a plurality of contacts, a holding member and a pair of arms. The holding member holds the contacts so that the contacts are arranged in a first direction. The pair of arms is held by the holding member. The arms extend from the holding member in a second direction perpendicular to the first direction while being apart from each other in the first direction. Each of the arms includes a fixing portion and a spring portion. The fixing portion is configured to be fixed to the mounted object. The fixing portion is provided with an abutment portion. The spring portion extends continuously from the fixing portion so as to be elastically bendable outward in the first direction. The spring portion is provided with a latch and an abutting portion. The latch is configured to be engaged with the side edge of the card under a connected state where the card edge connector and the card are connected to each other. The abutting portion is configured, when the card in the connected state presses the latch to move in a third direction perpendicular to both the first direction and the second direction, to be brought into abutment with the abutment portion in the third direction so that the abutting portion regulates a movement of the latch in the third direction.

An appreciation of the objectives of the present invention and a more complete understanding of its structure may be had by studying the following description of the preferred embodiment and by referring to the accompanying drawings.

Figure 1:
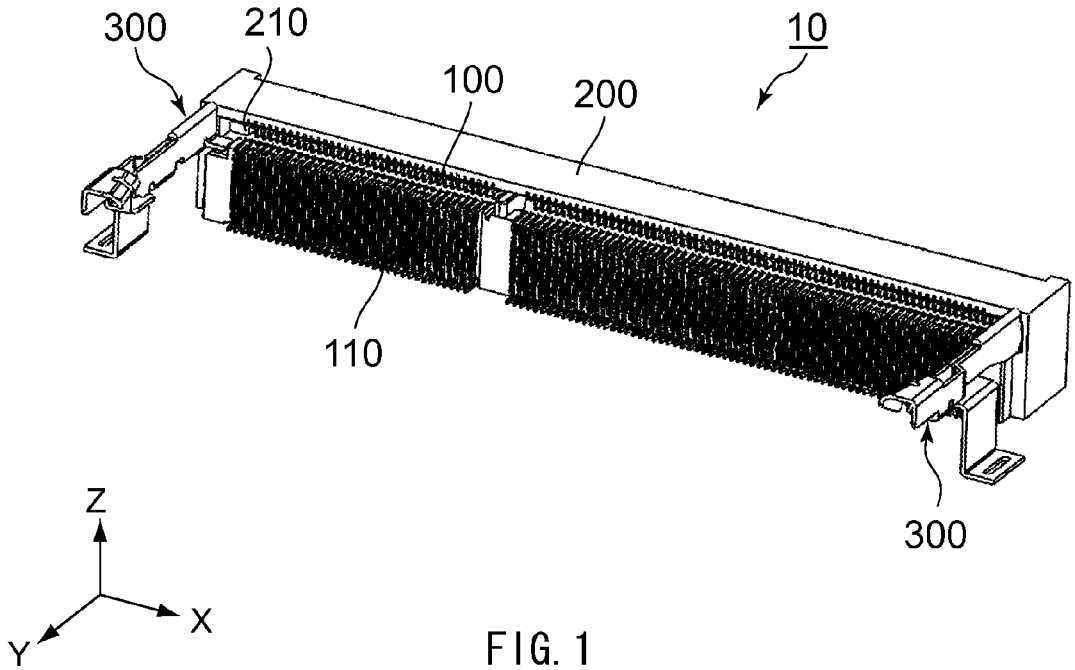
FIG. 1 is a perspective view showing a card edge connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 4, a card edge connector 10 according to an embodiment of the present invention is mountable to a mounted object (not shown) and connectable to a card 50 having a side edge 64. In detail, the card edge connector 10 is configured to be attached and fixed to a relatively large circuit board (mounted object) such as a motherboard. Furthermore, the card edge connector 10 is configured to be connected to the card 50 comprising a relatively small circuit board 60 and a plurality of semiconductor packages 70 mounted on the circuit board 60. For example, when two or more cards 50 are connected with a motherboard (mounted object) installed in a limited space (for example, inside of a notebook PC), the cards 50 are layered above the motherboard so as to be connected with the motherboard. The card edge connector 10 is usable as an outer side (upper side) card edge connector under the aforementioned connection of the card 50 with the motherboard.

Figure 3:
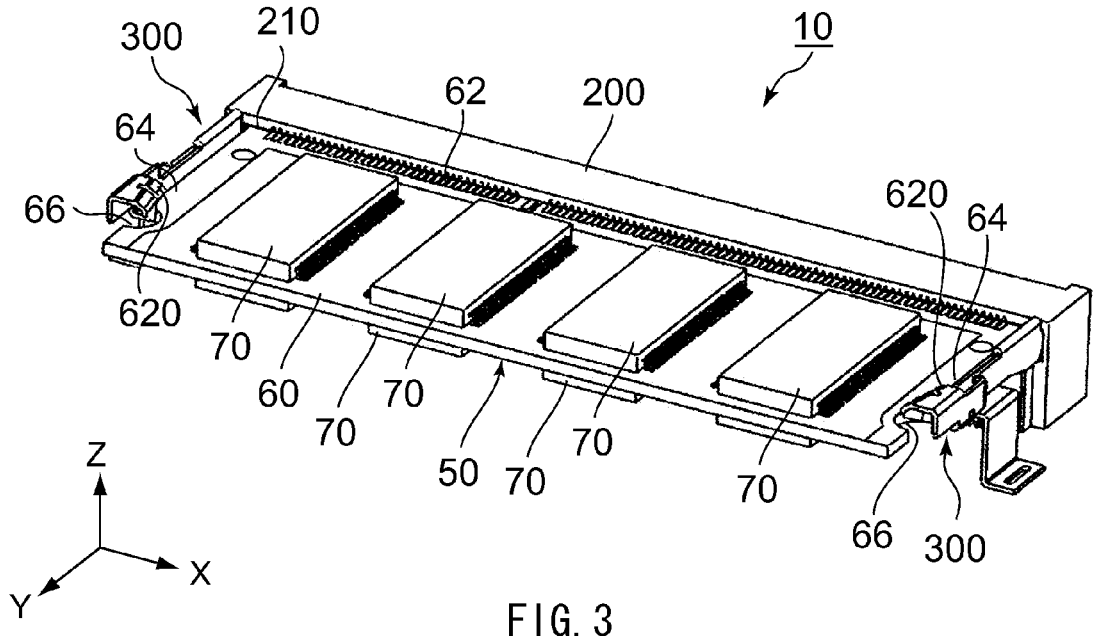
FIG. 3 is a perspective view showing the card edge connector of FIG. 1 and a memory module, wherein the card edge connector and the memory module are connected to each other.
Figure 4:
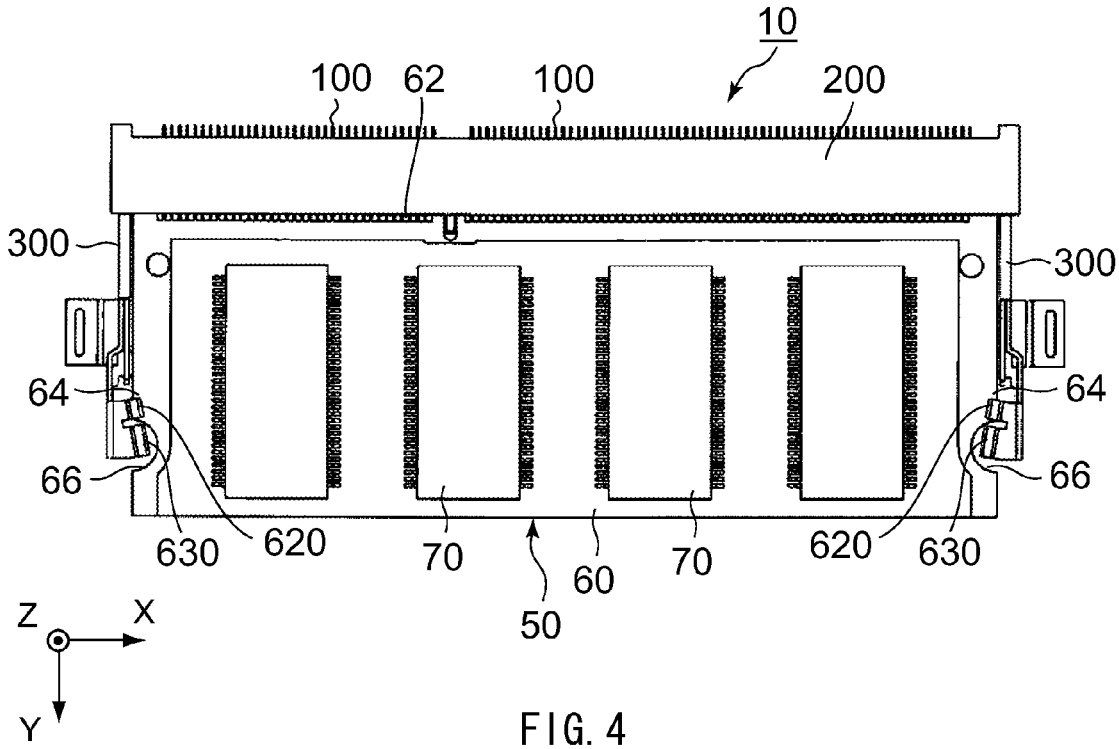
FIG. 4 is a top view showing the card edge connector and the memory module of FIG. 3.
Figure 10:
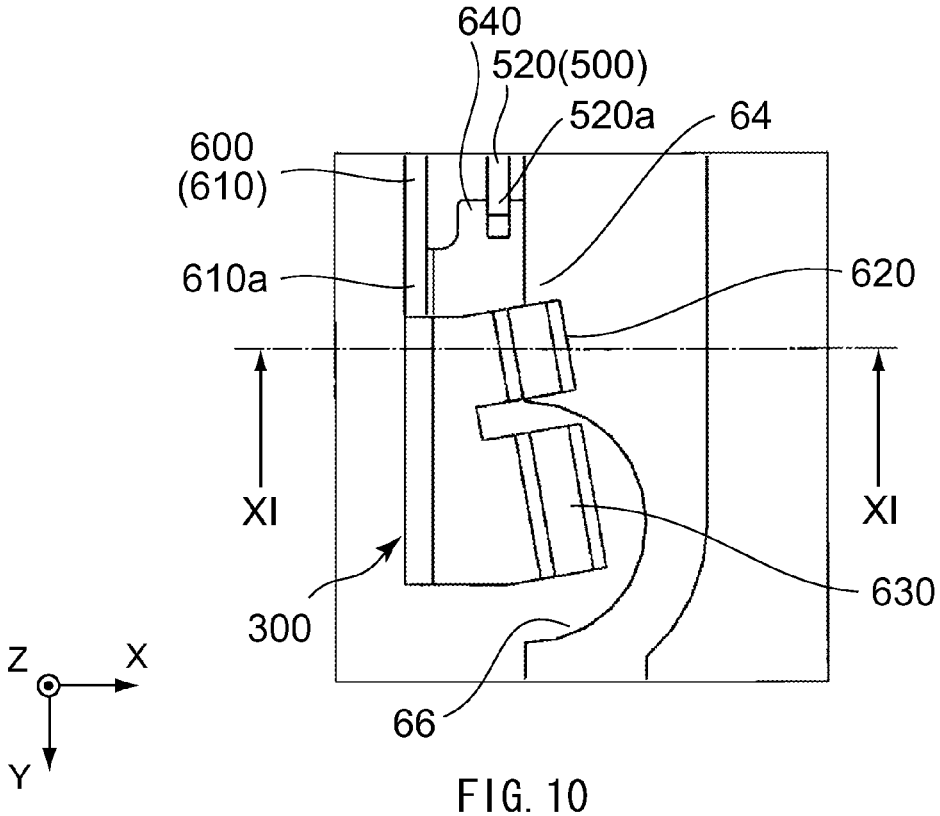
FIG. 10 is an enlarged, top view showing about a latch of the card edge connector of FIG. 4.

As shown in FIGS. 3 and 4, the card 50 according to the present embodiment is a memory module comprising a circuit board 60 and semiconductor packages 70 mounted on the circuit board 60. Each semiconductor package 70 according to the present embodiment is a DRAM package. The circuit board 60 has a plurality of terminals 62 provided on a leading end (connection edge) thereof for establishing an electrical connection with the card edge connector 10. As shown in FIGS. 3, 4 and 10, the circuit board 60 has a semicircular shaped notch 66 formed on the side edge 64 thereof. In the following description, the Z-direction (third direction) is the vertical direction. The positive Z-side and the negative Z-side may be referred to as the upper side and the lower side, respectively.

Figure 2:
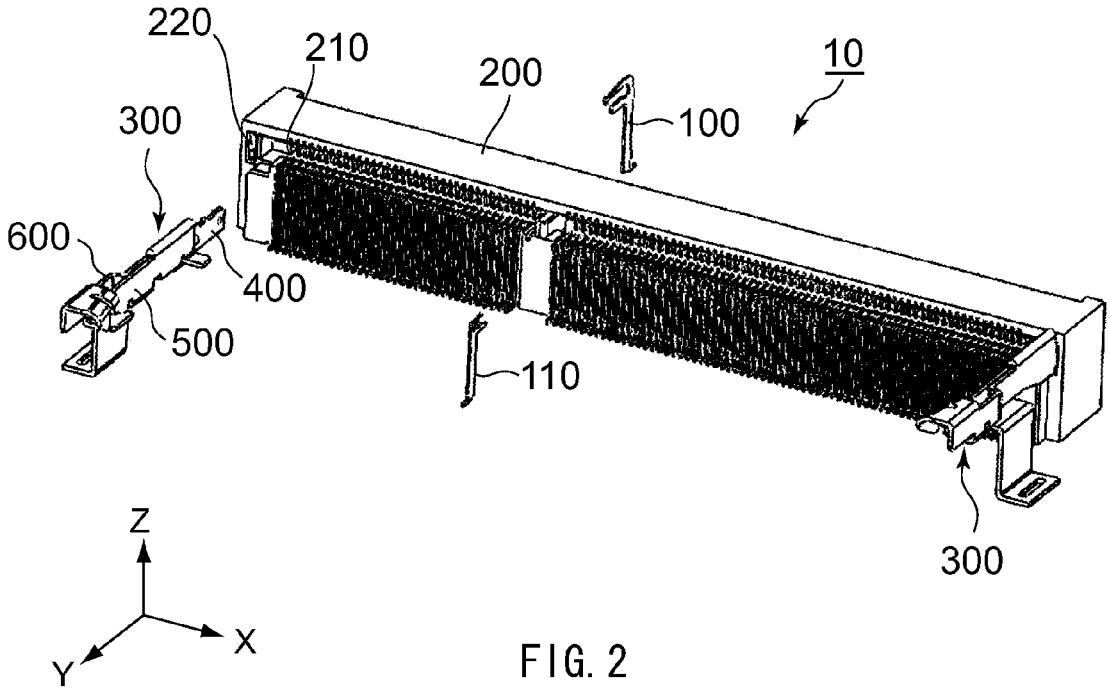
FIG. 2 is an exploded, perspective view showing the card edge connector of FIG. 1.

As shown in FIGS. 1 and 2, the card edge connector 10 comprises a plurality of upper contacts 100 each made of a metal, a plurality of lower contacts 110 each made of a metal, a holding member 200 made of an insulating material and a pair of arms 300 each made of a metal. The holding member 200 extends long in the X-direction (first direction). The holding member 200 has an opening 210 and two press-fit grooves 220. The opening 210 is formed on the upper side of the holding member 200. The opening 210 extends long in the X-direction so as to be able to accommodate the connection edge of the card 50 along the Y-direction (second direction). The two press-fit grooves 220 are formed on both sides of the opening 210 in the X-direction, respectively. The holding member 200 holds the plurality of the upper contacts 100 so that the upper contacts 100 are arranged in the X-direction and exposed partially in the opening 210. Similarly, the holding member 200 holds the plurality of the lower contacts 110 so that the lower contacts 110 are arranged in the X-direction and exposed partially in the opening 210. Upon the connection of the card 50 to the card edge connector 10, the connection edge of the card 50 is inserted obliquely downward into the opening 210. Then, the card 50 is turned to be put in a horizontal position. The terminals 62 of the card 50 are connected to both the respective upper contacts 100 and the respective lower contacts 110 of the card edge connector 10 by the aforementioned operation. The arm 300 is configured to maintain a connected state where the card edge connector 10 and the card 50 are connected to each other. More specifically, the arm 300 has structures as described below in detail.

As can be seen from FIGS. 1 and 2, the two arms 300 are press-fitted in the two press-fit grooves 220 located at the both sides of the opening 210 in the X-direction, respectively. Each of the arms 300 is held by the press-fit groove 220 of the holding member 200 so as to extend in the Y-direction. In detail, the arms 300 extend in the Y-direction from the holding member 200 while being apart from each other in the X-direction so that the holding member 200 and the arms 300 define the inside of the card edge connector 10 enclosed thereby. As shown in FIG. 2, the two arms 300 are arranged to be mirror images of each other. More specifically, the two arms 300 are arranged to be symmetrical with respect to the YZ-plane perpendicular to the X-direction.

Figure 5:
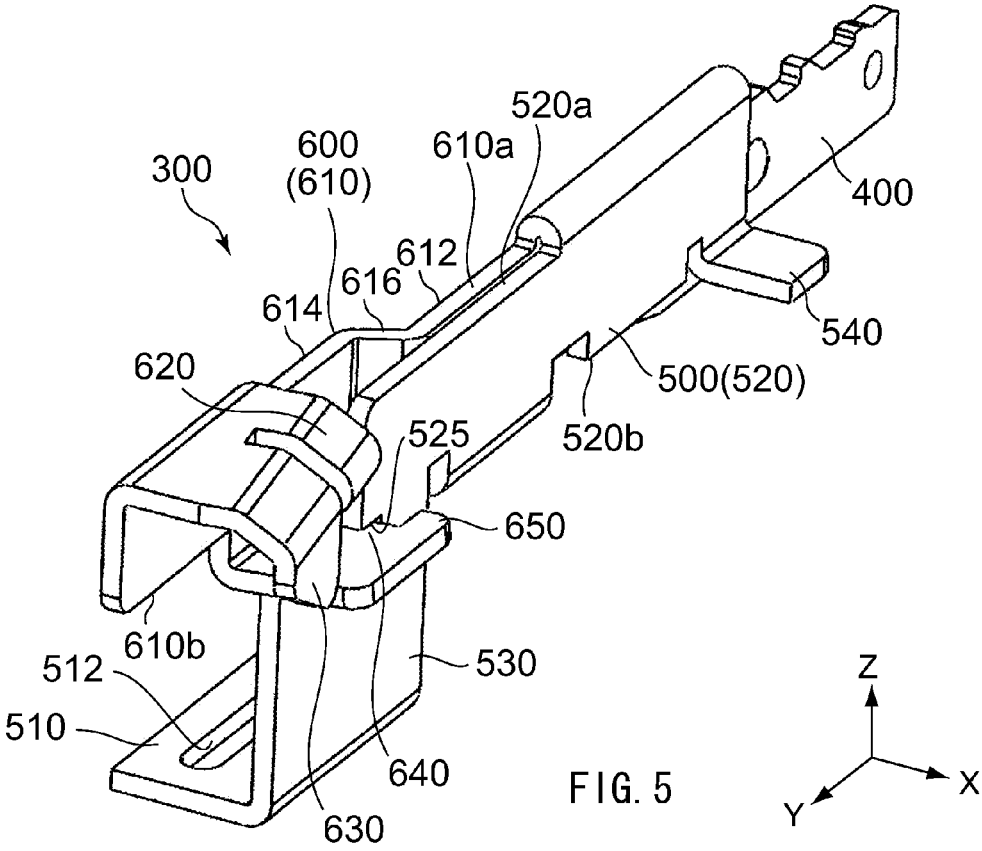
FIG. 5 is a perspective view showing an arm of the card edge connector of FIG. 1.

The arm 300 according to the present embodiment is illustrated in FIG. 5. On the other hand, an arm 300' according to a modification of the arm 300 of FIG. 5 is illustrated in FIGS. 6 to 9. While the arm 300' has roughly similar structure to the arm 300, the arm 300 and the arm 300' have some different structures from each other. In detail, while the arm 300 is provided with an interference portion 630 and an abutting portion 640, the arm 300' is provided with an interference portion 630' and an abutting portion 640'. The interference portion 630' and the abutting portion 640' have different structures from the interference portion 630 and the abutting portion 640, respectively. The other portions of the arm 300' have same or similar structures to the respective portions of the arm 300. Hereinafter, it is described about both the arm 300 according to the present embodiment and the arm 300' according to the modification. In the following description, the portions of the arm 300' which have structures same as or similar to the respective portions of the arm 300 are indicated with same marks to the respective portions of the arm 300.

Referring to FIGS. 5 to 9, each of the arms 300 and 300' is made by stamping out a single metal and bending the stamped-out metal. Each of the arms 300 and 300' includes a press-fit portion 400, a fixing portion 500 and a spring portion 600. The press-fit portion 400 is configured to be press-fitted into the press-fit groove 220 of the holding member 200. The fixing portion 500 is configured to be fixed to the mounted object such as a motherboard (not shown). The spring portion 600 extends continuously from the fixing portion 500. According to the present embodiment or the modification, the spring portion 600 extends continuously from the press-fit portion 400. The spring portion 600 has elasticity. In detail, the spring portion 600 is formed so as to be bendable elastically outward in the X-direction (i.e. toward the outside of the card edge connector 10). As previously described, each of the arm 300 according to the present embodiment and the arm 300' according to the modification is made from a single metal. Moreover, as described later, the spring portion 600 is provided with a latch 620 at a leading end thereof. Therefore, as can be best seen from FIG. 7, the fixing portion 500 according to the present embodiment or the modification is shorter than the spring portion 600 in the Y-direction.

As shown in FIGS. 5 to 9, the fixing portion 500 is provided with an attached portion 510, a fixing body portion 520, a support portion 530 and a pressing portion 540. The attached portion 510 is configured to be attached to the motherboard on which the card edge connector 10 is mounted. The fixing body portion 520 extends continuously from the spring portion 600 in the Y-direction so as to have an upper edge **520*a* and a lower edge 520*b* formed on opposite ends thereof in the Z-direction, respectively. The attached portion 510 and the fixing body portion 520 are connected with each other by the support portion 530. The pressing portion 540 is pressed against the holding member 200 (i.e. applied force along the negative Y-direction) when the press-fit portion 400 is press-fitted into the press-fit groove 220**.

Figure 6:
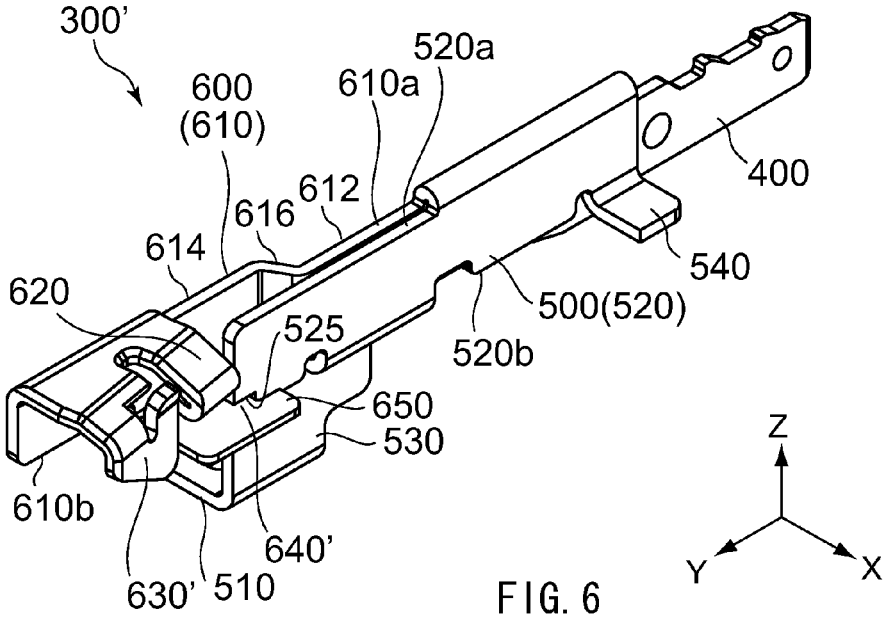
FIG. 6 is a perspective view showing a modification of the arm of FIG. 5.
Figure 8:
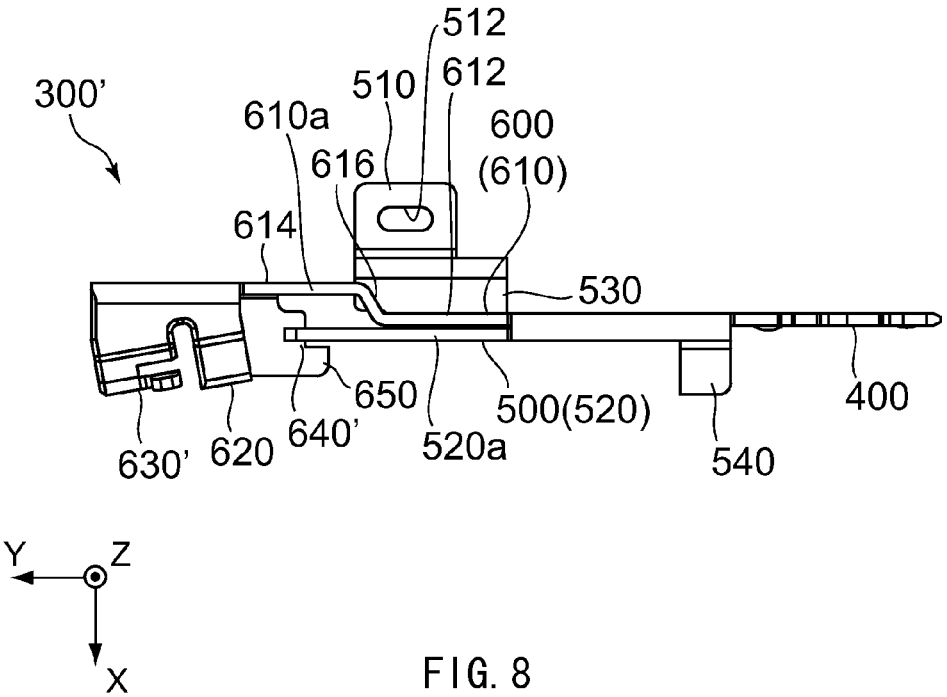
FIG. 8 is a top view showing the arm of FIG. 6.

As shown in FIGS. 5, 6 and 8, the attached portion 510 is shaped in a tab-like shape and formed with a hole 512. The attached portion 510 is configured to be soldered to a pad (not shown) of the motherboard. The arm 300 or 300' is fixed to the motherboard by the aforementioned soldering. The arm 300 or 300' is able to be fixed to the motherboard more securely by threading a screw through the hole 512 of the attached portion 510 to fix the screw to the motherboard.

As previously described, the card edge connector 10 is an outer side (upper side) card edge connector used in the case where the cards 50 are connected with the motherboard in such a manner that the cards 50 are layered above the motherboard (for example, see FIG. 3). Therefore, when the card edge connector 10 is used, another card edge connector (a lower side card edge connector) which holds another card is placed under the card 50 which is held by the card edge connector 10. The card edge connector 10 is configured to enable the aforementioned placement of the lower side card edge connector. More specifically, the fixing portion 500 according to the present embodiment or the modification has the support portion 530. As shown in FIGS. 5 to 7 and 9, when the attached portion 510 is attached to the motherboard, the support portion 530 supports the fixing body portion 520 so that the fixing body portion 520 is a predetermined distance apart from the motherboard in the Z-direction. The illustrated support portion 530 extends so as to avoid interference or contact with the lower side card edge connector. In detail, the support portion 530 extends outward in the X-direction from the lower edge **520*b* of the fixing body portion 520. Then, the support portion 530 extends to the attached portion 510 downwardly (i.e. along the negative Z-direction). As can be best seen from FIG. 9, the support portion 530 according to the present embodiment or the modification has an L-like shaped cross-section or a mirror image cross-section of the L-like shaped cross-section in the XZ-plane. In general, in a case where a card edge connector includes the support portion 530 having the aforementioned structures, the fixing body portion 520 of the fixing portion 500 tends to move unstably (i.e. tends to sway). Therefore, the card edge connector having the aforementioned support portion 530 is more likely to be damaged if this invention is not applied thereto. In other words, the effect of this invention is more likely to appear when this invention is applied to the upper side card edge connector having the support portion 530 according to the present embodiment or the modification. However, for example, this invention is applicable to the lower side card edge connector without the support portion 530. Moreover, this invention is applicable to a card edge connector other than the card edge connector 10 which has the aforementioned fixing portion 500**.

Figure 7:
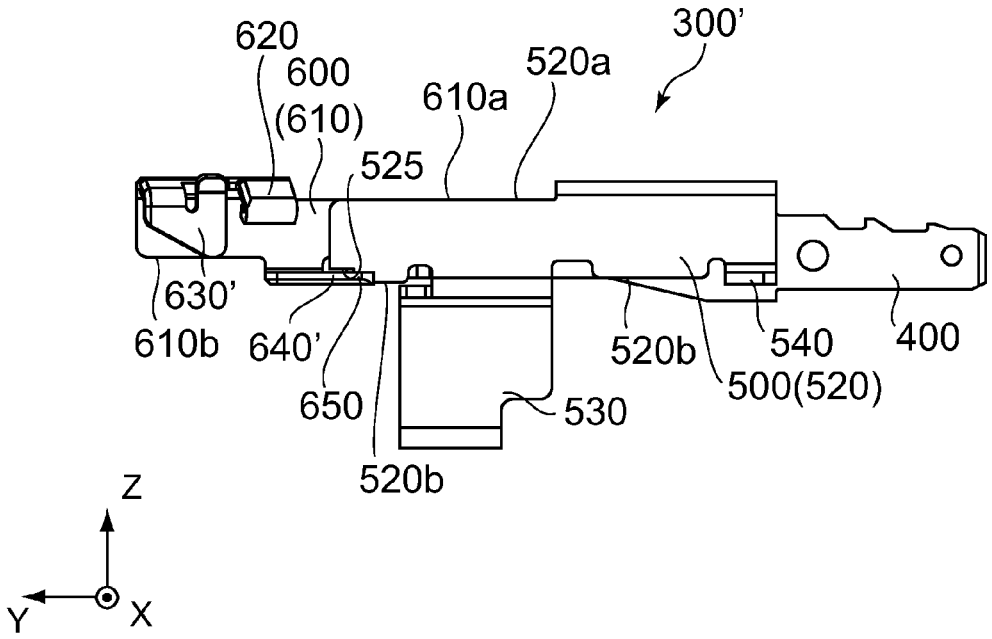
FIG. 7 is a side view showing the arm of FIG. 6, as seen from the inside of the card edge connector.

As shown in FIGS. 5 to 7, the fixing body portion 520 has a flat-board-like shape. In detail, the fixing body portion 520 extends in parallel with the YZ-plane so as to be long in the Y-direction while being short in the Z-direction. The fixing body portion 520 is connected to the spring portion 600 at the upper edge 520*a* thereof. In detail, the fixing body portion 520 and the spring portion 600 are connected to each other at a position in the vicinity of the holding member 200 so that the spring portion 600 has elasticity. The fixing body portion 520 of the fixing portion 500 is located inward of the spring portion 600 in the X-direction. In other words, the fixing body portions 520 of the fixing portions 500 of the two arms 300 (or the two arms 300') face each other in the X-direction. Therefore, under the connected state of the card 50 with the card edge connector 10 according to the present embodiment or the modification, the fixing body portion 520 is located between the spring portion 600 and the card 50 so that the card 50 is not brought into abutment with the spring portion 600. The card 50 connected to the card edge connector 10 according to the present embodiment or the modification is prevented more securely from being removed unintentionally than the card 50 connected to a card edge connector which has the fixing body portion 520 located outward of the spring portion 600 in the X-direction.

As shown in FIGS. 5 to 7 and 9, the fixing body portion 520 of the fixing portion 500 is provided with an abutment portion 525. The abutment portion 525 is formed in the vicinity of a leading end of the lower edge 520*b* of the fixing body portion 520 in the Y-direction. As can be best seen from FIG. 7, the fixing body portion 520 is cut at a corner located in the vicinity of the leading end of the lower edge 520*b* in the Y-direction so that the fixing body portion 520 is formed with a notch having an L-like shape. The abutment portion 525 according to the present embodiment or the modification is an upper edge of the aforementioned notch. In other words, the abutment portion 525 is located at an end of the fixing portion 500 in both the Y-direction and the Z-direction.

As shown in FIGS. 5, 6 and 8, the spring portion 600 has a spring body portion 610, a latch 620, an interference portion 630 or 630', an abutting portion 640 or 640' and a stopper 650. The spring body portion 610 extends continuously from the fixing body portion 520 of the fixing portion 500 so as to have opposite edge portions, i.e. an upper edge 610*a* and a lower edge 610*b*, in the Z-direction. The spring body portion 610 has two flat-board-like portions and a bent portion 616 located between the two flat-board-like portions in the Y-direction. Each of the flat-board-like portions extends in parallel with the YZ-plane so as to be long in the Y-direction while being short in the Z-direction. While the length of the spring body portion 610 in the Y-direction is nearly equal to the summation of the lengths of the two flat-board-like portions in the Y-direction, the total length of the spring body portion 610 along the extending direction is longer than the length of the spring body portion 610 in the Y-direction so that the elasticity of the spring portion 600 is improved. More specifically, the spring body portion 610 is provided with a first spring portion 612 having a flat-board-like shape, a second spring portion 614 having a flat-board-like shape and the bent portion 616. The first spring portion 612 extends continuously from the fixing body portion 520 of the fixing portion 500. The second spring portion 614 supports the latch 620. The bent portion 616 connects the first spring portion 612 and the second spring portion 614 with each other. The bent portion 616 extends obliquely to both the X-direction and the Y-direction. The first spring portion 612 and the second spring portion 614 according to the present embodiment or the modification are connected with each other by the bent portion 616 so as to extend in parallel with each other. Each of the latch 620 and the interference portion 630 or 630' is formed in the vicinity of a leading end of the spring body portion 610 in the Y-direction so as to be located at a position beyond the leading end of the fixing body portion 520 in the Y-direction. Each of the abutting portion 640 or 640' and the stopper 650 is located in the vicinity of the leading end of the fixing body portion 520 in the Y-direction. As compared with any one of the latch 620 and the interference portion 630 or 630', each of the abutting portion 640 or 640' and the stopper 650 is nearer to the holding member 200.

As shown in FIGS. 5 to 11, the latch 620 is configured to be engaged with the side edge 64 of the circuit board 60 of the card 50 under the connected state of the card edge connector 10 with the card 50. The engagement of the latch 620 with the side edge 64 keeps the connected state of the card edge connector 10 with the card 50. The latch 620 according to the present embodiment or the modification is formed by bending a part of the spring body portion 610 so that the latch 620 extends from the upper edge 610*a* (i.e. one of the edge portions) of the spring body portion 610 inward in the X-direction (i.e. toward the inside of the card edge connector 10). The latch 620 has a J-like cross-section in the XZ-plane (i.e. in a plane defined by the first direction and the third direction). The latch 620 has thus shaped cross-section so that, as compared with a latch which has an edge configured to be brought into contact with a card, the latch 620 is not likely to be damaged when the card 50 is removed forcibly.

Referring to FIGS. 5, 6 and 10, the interference portion 630 or 630' is configured to prevent the latch 620 from being engaged with the side edge 64 when the card 50 is not properly connected to the card edge connector 10. More specifically, the illustrated interference portion 630 or 630' is, as compared with the latch 620, located nearer to the leading end of the spring body portion 610 in the Y-direction. The interference portion 630 or 630' protrudes inward in the X-direction from the upper edge 610*a*. The interference portion 630 or 630' is located in the notch 66 formed on the side edge 64 of the card 50 in the XY-plane when the card 50 is properly connected to the card edge connector 10 (i.e. when the card 50 is in the connected state). On the other hand, when the card 50 is not properly connected to the card edge connector 10 (i.e. when the card 50 is in an incomplete connection state), the interference portion 630 or 630' interferes with the side edge 64. More specifically, at least a part of the interference portion 630 or 630' is brought into contact with the side edge 64 under the incomplete connection state. The latch 620 is unable to be engaged with the side edge 64 when the interference portion 630 or 630' interferes with the side edge 64 so that the incomplete connection state is not kept. Comparing FIG. 5 with FIG. 6, it can be seen that the interference portion 630 according to the present embodiment and the interference portion 630' according to the modification have different shapes from each other. However, both the interference portion 630 and the interference portion 630' have the aforementioned function which prevents the incomplete connection state from being kept.

As shown in FIGS. 5 to 9 and 11, the abutting portion 640 or 640' is a board-like portion which is formed so as to project and extend from the lower edge 610*b* of the spring body portion 610 (i.e. from a remaining one of the edge portions of the spring portion 600) inward in the X-direction. The abutting portion 640 or 640' is partially located below the abutment portion 525 in the Z-direction. Under the connected state of the card edge connector 10 with the card 50, the abutting portion 640 is placed under the card 50 while the latch 620 is placed on the card 50. When the card 50 in the connected state is forced to be removed from the card edge connector 10, the card 50 presses the latch 620 to move in the positive Z-direction (i.e. upwardly).The abutting portion 640 or 640' according to the present embodiment or the modification is configured to be brought into abutment with the abutment portion 525 in the Z-direction when the latch 620 is moved upwardly so that the abutting portion 640 or 640' regulates a movement of the latch 620 in the positive Z-direction. Thus, the latch 620 is not disengaged from the side edge 64 easily.

Figure 11:
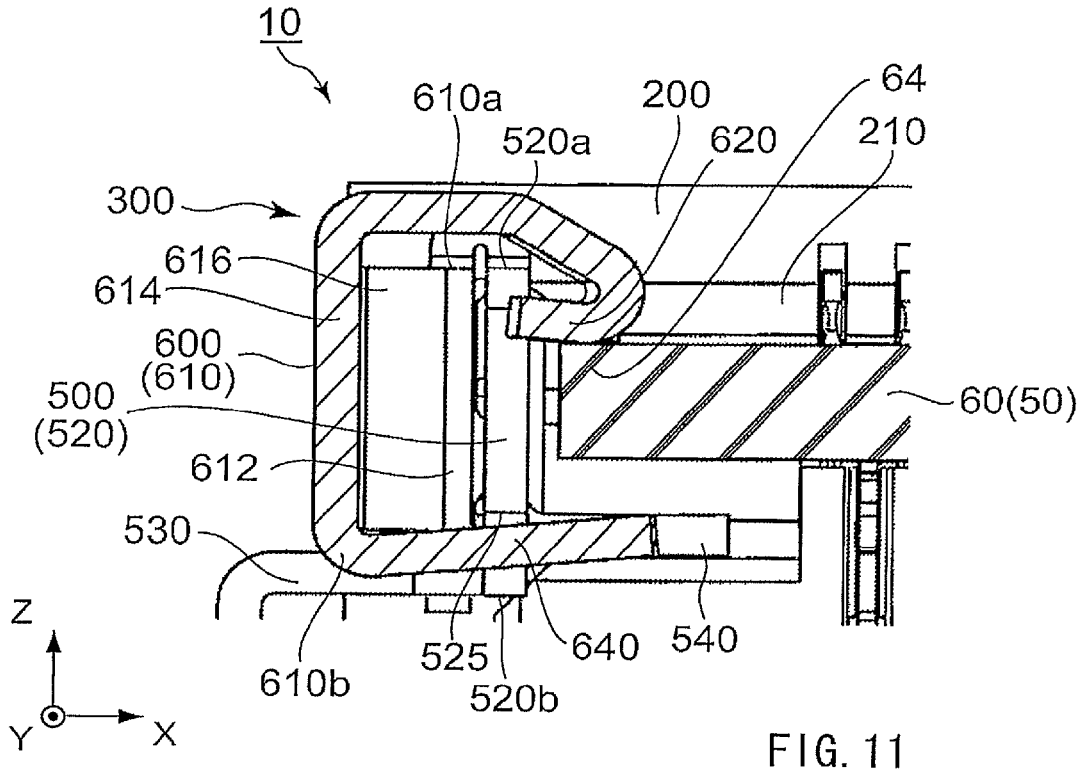
FIG. 11 is a cross-sectional view showing the card edge connector of FIG. 10, taken along lines XI-XI.
Figure 12:
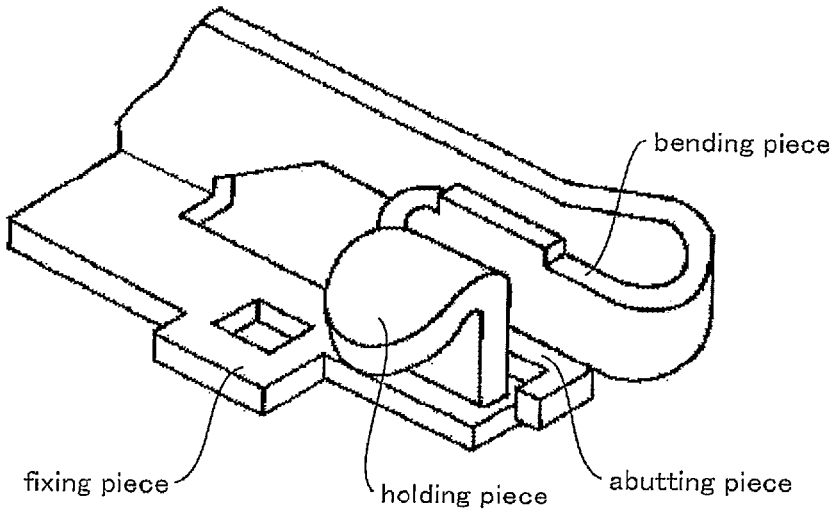
FIG. 12 (PRIOR ART)
FIG. 12 is a perspective view showing a part of the connector disclosed in JP-A H11(1999)-16646.

As shown in FIGS. 1 to 5 and 11 (especially, as shown in FIG. 11), the abutting portion 640 according to the present embodiment extends obliquely to both the X-direction and the Z-direction. More specifically, the abutting portion 640 extends obliquely upward from the lower edge 610*b* of the spring body portion 610 while extending inward in the X-direction. Therefore, when the abutting portion 640 is brought into abutment with the abutment portion 525 in the Z-direction, the abutting portion 640 receives, from the abutment portion 525, a reaction force which is a resultant force of a force directed inward in the X-direction and a force along the negative Z-direction (i.e. a force directed away from the abutment portion 525 in the Z-direction). In other words, the reaction force applied to the abutting portion 640 by the abutment portion 525 is directed obliquely downward so that the reaction force is directed inward in the X-direction. As can be seen from the above description, when the latch 620 is forced to move in the positive Z-direction (i.e. when a force along the positive Z-direction is applied to the latch 620), the abutting portion 640 also receives a force along the positive Z-direction so that the abutting portion 640 is brought into abutment with the abutment portion 525. The latch 620 is drawn inward in the X-direction (i.e. toward the card 50 in the X-direction) by the reaction force applied to the abutting portion 640. Therefore, according to the present embodiment, it is possible to prevent an unintentional disengagement of the latch 620 more securely.

Figure 9:
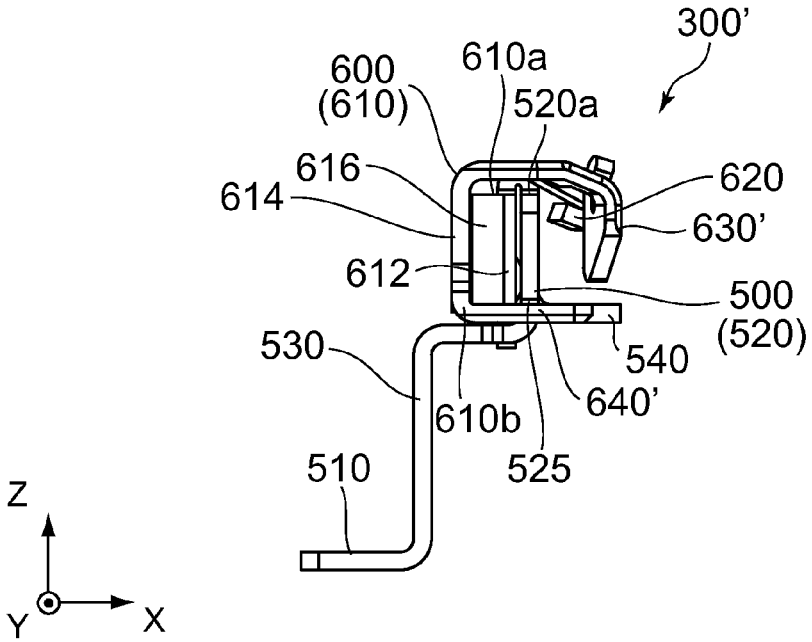
FIG. 9 is a front view showing the arm of FIG. 6.

On the other hand, referring to FIGS. 6 to 9 (especially, as shown in FIG. 9), the abutting portion 640' of the arm 300' according to the modification is formed so as to extend in a plane perpendicular to the Z-direction. When comparing the arm 300' according to the modification (see FIGS. 6 to 9) with the arm 300 according to the present embodiment (see FIGS. 1 to 5 and 11), while the arm 300' has more simple structures than the arm 300, the arm 300 has more preferable structures for preventing the unintentional disengagement of the latch 620 more securely.

As shown in FIGS. 5, 6 and 8, the stopper 650 extends from the abutting portion 640 or 640' along the negative Y-direction. More specifically, the stopper 650 projects along the Y-direction toward the holding member 200 from inward of the abutting portion 640 or 640' in the X-direction. The stopper 650 and the fixing portion 500 define a predetermined range within which the spring portion 600 is bendable. More specifically, the fixing body portion 520 of the fixing portion 500 has an inside surface facing inward in the X-direction. The stopper 650 is brought into contact with and stopped by a predetermined part of the inside surface of the fixing body portion 520 when the spring portion 600 is bent excessively outward in the X-direction so that the spring portion 600 is prevented from being bent over the predetermined range. In other words, the stopper 650 regulates the bent of the spring portion 600 outward in the X-direction within the predetermined range. According to the present embodiment or the modification, the stopper 650 and the abutting portion 640 or 640' are located to be close to each other. In detail, the predetermined part of the inside surface of the fixing body portion 520 which is brought into contact with the stopper 650 is located below the abutment portion 525 in the Z-direction and is located at the negative Y-side of the abutment portion 525 in the Y-direction. The stopper 650 according to the present embodiment or the modification extends continuously from the abutting portion 640 or 640'. In other words, the stopper 650 and the abutting portion 640 or 640' are formed on a common piece. However, the stopper 650 and the abutting portion 640 or 640' may be formed variously. For example, a part which functions as the stopper 650 and a part which functions as the abutting portion 640 or 640' may be formed on different pieces from each other.

According to the present embodiment or the modification, the abutment portion 525 is formed on the lower edge 520*b* of the leading end of the fixing body portion 520 in the Y-direction. However, the abutment portion 525 may be formed on a part being apart from the lower edge 520*b*. In other words, the abutment portion 525 may be unconnected to the lower edge 520*b*. Furthermore, the abutment portion 525 may be formed on another position than the leading end of the fixing body portion 520 in the Y-direction. For example, the fixing body portion 520 may be formed with a rectangular hole while the spring body portion 610 may be formed with a piece extending therefrom and passing through the rectangular hole. In this case, an upper edge of the rectangular hole functions as an abutment portion while the piece in the rectangular hole functions as an abutting portion. The piece may extend in a plane perpendicular to the Y-direction so as to be formed with an upper edge and a lower edge located on opposite ends in the Z-direction, respectively. Moreover, the upper edge of the piece may extend obliquely to both the X-direction and the Z-direction. However, it is difficult to efficiently prevent the card 50 from being removed forcibly in a case where an abutment portion is far away from the latch 620. Therefore, it is preferable that an abutment portion is located as near as possible to the latch 620. More specifically, it is preferable that an abutment portion is formed on the leading end of a fixing body portion 520.

The present application is based on a Japanese patent application of JP2010-293082 filed before the Japan Patent Office on Dec. 28, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A card edge connector mountable to a mounted object and connectable to a card having a side edge, the card edge connector comprising:

a plurality of contacts;

a holding member holding the contacts so that the contacts are arranged in a first direction, and a pair of arms held by the holding member, the arms extending from the holding member in a second direction perpendicular to the first direction while being apart from each other in the first direction, each of the arms including a fixing portion and a spring portion, the fixing portion being configured to be fixed to the mounted object, the fixing portion being provided with an abutment portion, the spring portion extending continuously from the fixing portion so as to be elastically bendable outward in the first direction, the spring portion being provided with a latch and an abutting portion, the latch being configured to be engaged with the side edge of the card under a connected state where the card edge connector and the card are connected to each other, the abutting portion being configured, when the card in the connected state presses the latch to move in a third direction perpendicular to both the first direction and the second direction, to be brought into abutment with the abutment portion in the third direction so that the abutting portion regulates a movement of the latch in the third direction.

2. The card edge connector as recited in claim 1, wherein:

the fixing portion is shorter than the spring portion in the second direction; and the abutment portion is located at an end of the fixing portion in the second direction.

3. The card edge connector as recited in claim 2, wherein the abutment portion is located at an end of the fixing portion in the third direction.

4. The card edge connector as recited in claim 1, wherein:

the spring portion has a spring body portion which extends continuously from the fixing portion;

the spring body portion has opposite edge portions in the third direction; and the latch is formed so as to project from one of the edge portions of the spring body portion inward in the first direction, the latch having a J-like cross-section in a plane defined by the first direction and the third direction.

5. The card edge connector as recited in claim 4, wherein the abutting portion is formed so as to project from a remaining one of the edge portions of the spring body portion inward in the first direction.

6. The card edge connector as recited in claim 1, wherein:

the spring portion is provided with a stopper; and the stopper projects along the second direction from inward of the abutting portion in the first direction, the stopper being stopped by the fixing portion when the spring portion is bent outward in the first direction so that the stopper regulate the bent of the spring portion within a predetermined range.

7. The card edge connector as recited in claim 1, wherein:

the abutting portion extends obliquely to both the first direction and the third direction; and when the abutting portion is brought into abutment with the abutment portion in the third direction, the abutting portion receives a reaction force from the abutment portion, the reaction force being a resultant force of a force directed inward in the first direction and a force directed away from the abutment portion in the third direction.

8. The card edge connector as recited in claim 1, wherein the fixing portion is located inward of the spring portion in the first direction.

9. The card edge connector as recited in claim 1, wherein:

the fixing portion is provided with an attached portion, a fixing body portion and a support portion, the attached portion being configured to be attached to the mounted object, the fixing body portion extending continuously from the spring portion, the attached portion and the fixing body portion being connected with each other by the support portion; and when the attached portion is attached to the mounted object, the support portion supports the fixing body portion so that the fixing body portion is a predetermined distance apart from the mounted object in the third direction.

10. The card edge connector as recited in claim 9, wherein the fixing body portion is provided with the abutment portion.

* * * * *